US005539628A

United States Patent [19]

Seib

[11] Patent Number: 5,539,628

[45] Date of Patent: Jul. 23, 1996

[54] FILTERED LAMP ASSEMBLY

[76] Inventor: James N. Seib, Rte. 1, Williams, Ind. 47470

[21] Appl. No.: 329,896

[22] Filed: Oct. 27, 1994

[51] Int. Cl.[6] ..... F21V 9/00

[52] U.S. Cl. ..... 362/293; 362/62; 362/255; 362/267

[58] Field of Search ..... 362/62, 255, 256, 362/267, 293, 800, 363

[56] References Cited

U.S. PATENT DOCUMENTS

| | | | |
|---|---|---|---|
| 3,591,793 | 7/1971 | McKim | 362/293 |
| 4,829,407 | 5/1989 | Bushell et al. | 362/29 |
| 4,887,189 | 12/1989 | Garrett | 362/23 |
| 4,912,334 | 3/1990 | Anderson | 250/495.1 |
| 5,068,771 | 11/1991 | Savage, Jr. | 362/255 |
| 5,115,379 | 5/1992 | Nagai | 362/23 |
| 5,221,140 | 6/1993 | Oshino | 362/255 |

*Primary Examiner*—Stephen F. Husar
*Attorney, Agent, or Firm*—Woodard, Emhardt, Naughton, Moriarty & McNett

[57] ABSTRACT

A filtered lamp assembly useful for illuminating an aircraft cockpit instrument cluster. The lamp assembly includes an incandescent light bulb positioned within a housing that allows the emission of light having a wavelength in the range between about 380 and 620 nanometers. A wire form is positioned within the housing adjacent the light bulb and around the electrical leads extending from the light bulb so as to seal between the housing and the light bulb. The wire form prevents the leakage of a solidifable fluid material that is utilized to fix the light bulb and wire form into position. Further, a process for manufacturing a wire form minimizes the quantity of inventory and tooling necessary for the production of the filtered lamp assembly.

22 Claims, 3 Drawing Sheets

FILTERED LAMP ASSEMBLY

BACKGROUND OF THE INVENTION

The present invention relates generally to a filtered lamp assembly useful in one form for illuminating aircraft cockpit instruments. More particularly, in a preferred embodiment thereof, the present invention provides a significantly improved infrared filtered lamp assembly having a wire form therein for sealing between a light bulb and a filter housing. Although the filtered lamp assembly of the present invention was developed for use with aircraft instruments, certain applications may be outside of this field.

Aircraft cockpit instruments, such as altimeters, compasses, and the like, are typically illuminated for low light flying conditions by a series of small incandescent bulbs mounted on the instrument panel adjacent to the instruments or are integrally contained within the instruments for which they provide light. The infrared light generated by an illumination system of this general type can seriously interfere with the use of night vision equipment, such as night vision goggles worn by pilots to detect infrared markings, even in total darkness, of targets and reference points on the ground. To alleviate this interference with night vision equipment, various types of infrared filter structures have been used in conjunction with light bulbs to shield the cockpit area from the infrared light that is inherently generated by hot filaments.

Prior designers of filtered lamp assemblies have typically used a lamp assembly of the type that is illustrated in FIGS. 1 and 2. This light assembly includes a hollow tubular housing (a), an incandescent light bulb (b) that is disposed within the housing (a), and a disc shaped member (c). The member (c) has the electrical leads (e) that extend from the incandescent bulb (b) threaded therethrough. The disc shaped member (c) fits tightly within the hollow tubular housing (a) to prevent the potting material (d) from leaking into the cavity formed between the light bulb (b) and the housing (a).

The prior techniques utilized to seal between the light bulb (b) and the filter housing (a) have a plurality of limitations. One such limitation is the difficulty and the associated added labor expense associated with threading the electrical leads (e) through a pair of bores (f) formed in the disc shaped member (c). A second limitation of the prior technique of using a disc shaped member (c) is that the degree of flexibility in positioning the electrical leads (e) within the housing (a) is limited by the placement of bores (f) in disc (c). A third limitation associated with using the disc shaped member is that the manufacturer must maintain a large inventory of these members (c) in order to correspond with the multitude of different sized housings that the light bulb (b) is positioned within. By having to maintain a quantity of different sizes members (c) there is an increase in complexity associated with assembling the filtered lamp assembly, and a significant cost increase to this process. A fourth limitation is that the disc (c) is, by itself, a costly part to produce because its size poses a number of manufacturing difficulties.

Even with the variety of earlier designs there remains a need for an improved filtered lamp assembly. The present invention satisfies this need in a novel and unobvious way.

SUMMARY OF THE INVENTION

One embodiment of the present invention contemplates a filtered lamp assembly. The apparatus comprises: a housing, a light bulb positioned within the housing, the light bulb having electrical leads extending therefrom, a wire form positioned within the housing adjacent the light bulb and around the lead for sealing between the housing and the light bulb, and an optically opaque seal fixing the light bulb and wire form into position.

One object of one form of the present invention is to provide an improved filtered lamp assembly for use in illuminating aircraft cockpit instruments.

Related objects and advantages of the present invention will be apparent from the following description.

DESCRIPTION OF THE PREFERRED EMBODIMENT

Figure 1:
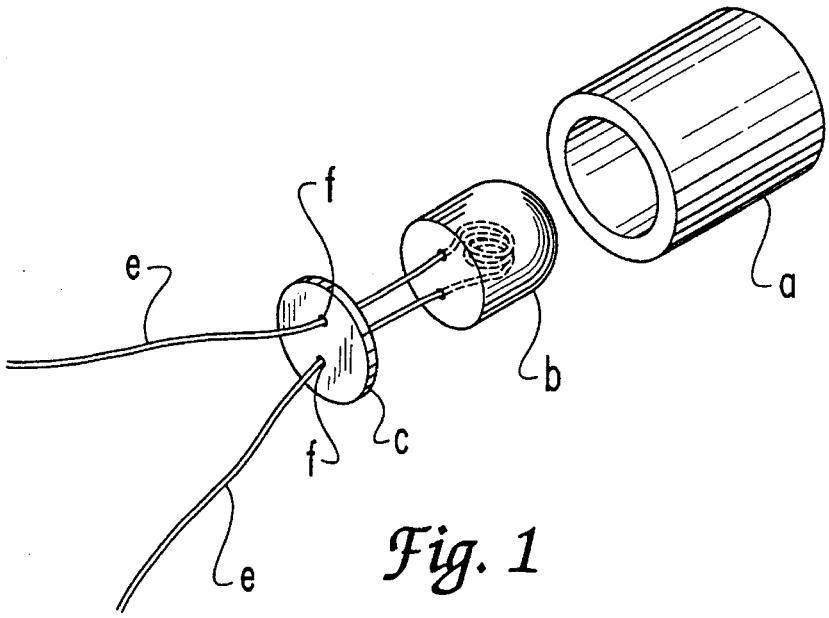
Fig. 1 (Prior Art)
FIG. 1 is a partially exploded view of a prior art filtered lamp assembly having a disc shaped member.
Figure 2:
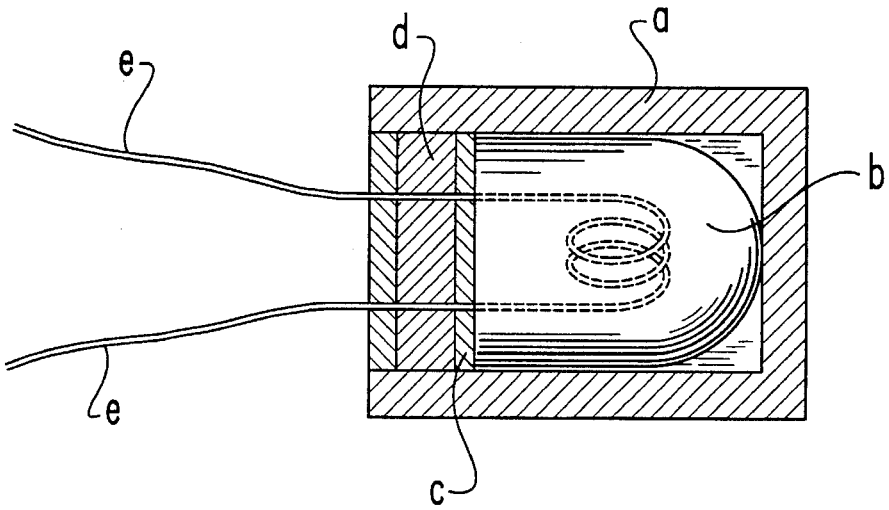
Fig. 2 (Prior Art)
FIG. 2 is a side elevational view in full section of the FIG. 1 filtered lamp assembly.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 3:
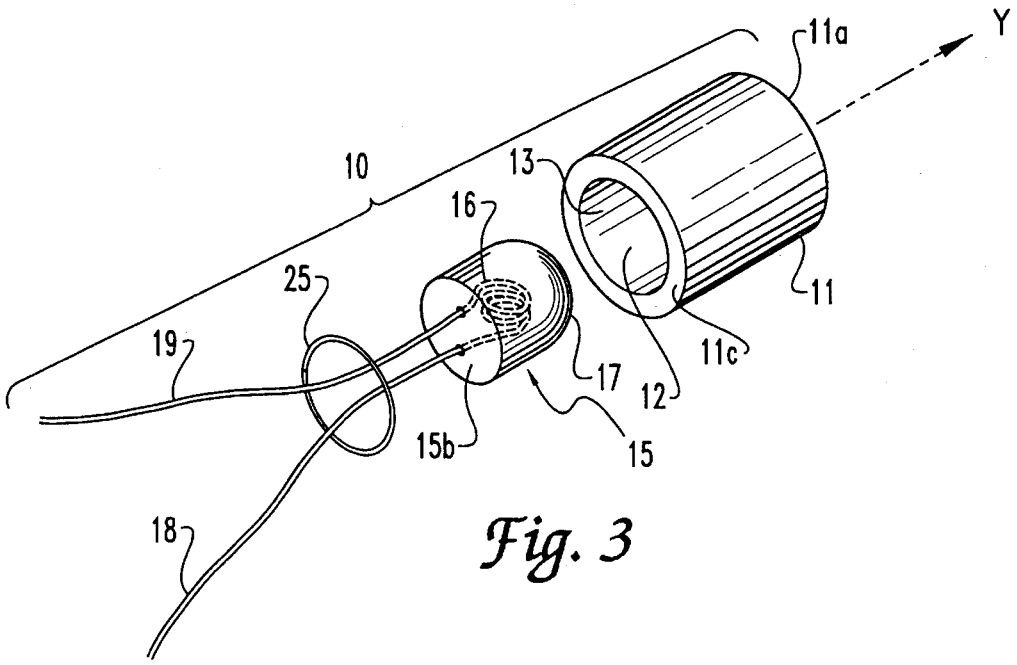
FIG. 3 is an exploded view of a filtered lamp assembly according to a typical embodiment of the present invention.
Figure 3A:
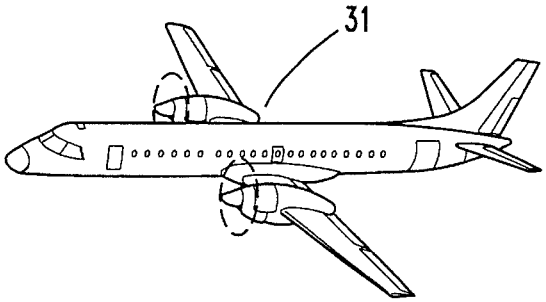
FIG. 3*a* is an aircraft incorporating cockpit instruments using the lamp assembly of FIG. 3.
Figure 3B:
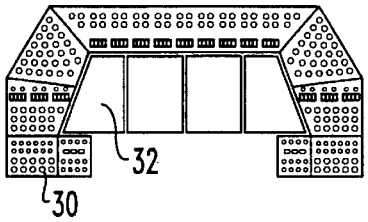
FIG. 3*b* is a cockpit in the aircraft of FIG. 3*a*, which cockpit uses the lamp assembly of FIG. 3

With reference to FIG. 3, there is illustrated an exploded view of a filtered lamp assembly 10. In one form of the present invention the filtered lamp assembly 10 provides illumination for aircraft cockpit instruments 30 (FIG. 3*b*) that are mounted within an aircraft 31 (FIG. 3*a*) near its windows 32. The filtered lamp assembly 10 comprises a substantially cylindrical housing 11, having a central axis y, that is closed at one end 11*a* by a planar wall 11*b* that is transverse to central axis y. One form of the filtered lamp assembly has a cylindrical housing with an external diameter of 0.210 inches. However, other sizes are contemplated by the present invention. Formed within the housing 11 is a central bore 12 which is parallel to the central axis y of housing 11. An inner cylindrical surface 13 is defined by the central bore 12 of housing 11.

A light bulb 15 is positioned within the central bore 12 of housing 11. The central bore 12 has a diameter large enough to permit the free passage of the light bulb 15 therein. In the preferred embodiment the light bulb 15 is an incandescent light bulb that is well known to change electrical energy to radiant energy. The light generated by the incandescent lamp results from a filament 16 being resistance heated to a temperature high enough to produce visible light. The light bulb 15 comprises the filament 16 that is arranged within a vacuum sealed (or gas filled) glass bulb envelope 17 to keep the filament 16 from operating in an atmosphere containing oxygen. Further, the light bulb 15 includes a first electrical lead 18 and a second electrical lead 19 that are connected to the filament 16 and extend substantially axially from the light bulb 15 to an electrical source (not illustrated).

Figure 4:
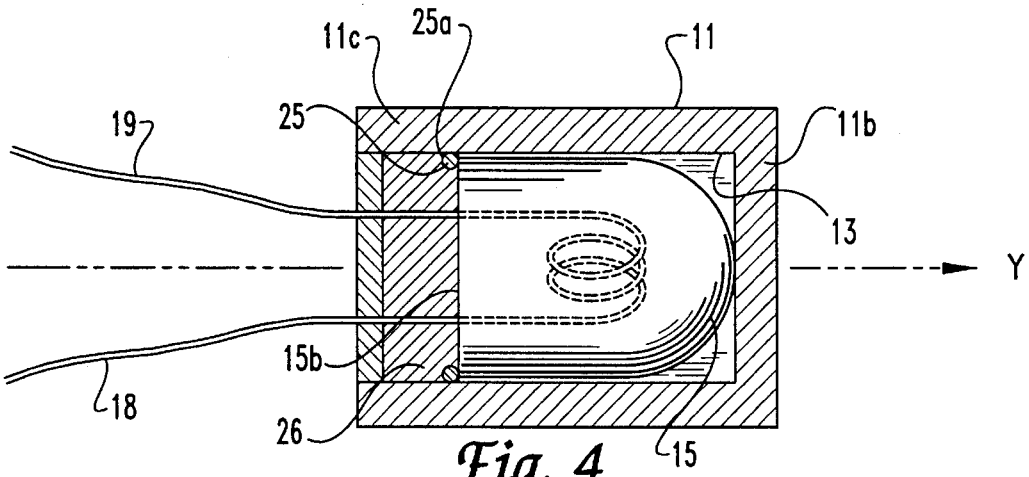
FIG. 4 is a side elevational view in full section of the FIG. 3 filtered lamp assembly.

Referring to FIG. 4, light bulb 15 is positioned within the central bore 12 such that there is radial clearance between the glass bulb envelope 17 of light bulb 15 and the inner cylindrical surface 13 of the housing 11. A wire form 25 (see also FIG. 5) is positioned within the housing 11 adjacent the light bulb 15 and around the first electrical lead 18 and the second electrical lead 19. In the preferred embodiment the circumferential surface 25*a* of wire form 25 snugly engages the inner cylindrical surface 13 of housing 11. The wire form 25 provides a seal between the inner cylindrical surface 13 of housing 11 and the light bulb 15. In one form of the present invention the wire form 25 is of a thermally conductive material. A preferred material for the wire form 25 is metal, and the most preferred metal is one that is malleable and ductile. A material that is substantially copper is well suited for wire form 25. In the preferred embodiment the wire form 25 is a ring structure.

Light bulb 15 has a planar end 15*b* that is arranged transverse to the center line y. The sealing interface of wire form 25 prevents a solidifiable material from leaking into the space between the light bulb 15 and the inner cylindrical surface 13 of housing 11. Near the second end 11*c* of housing 11 there is a seal 26 that is disposed within the housing 11 adjacent the inner cylindrical surface 13, the wire form 25, and the planar end 15*b* of the light bulb 15. The seal 26 fixes the light bulb 15 and the wire form 25 into position within the housing 11, while the electrical leads 18 and 19 extend therethrough. Further in the preferred embodiment the seal 26 is an opaque seal for preventing light from being emitted from end 11*b* of the housing 11.

In the preferred embodiment the housing 11 is substantially cylindrical and is formed from a filtering glass material that allows the emission of light having a wavelength in the range between about 380 and 620 nanometers. Alternatively, the housing 11 could be formed from a substantially cylindrical glass tubing that is coated with a filtering material that only allows the emission of light having a wavelength in a desired range, such as between about 380 and 620 nanometers. Further, the housing 11 is sealed by seal 26.

Figure 6:
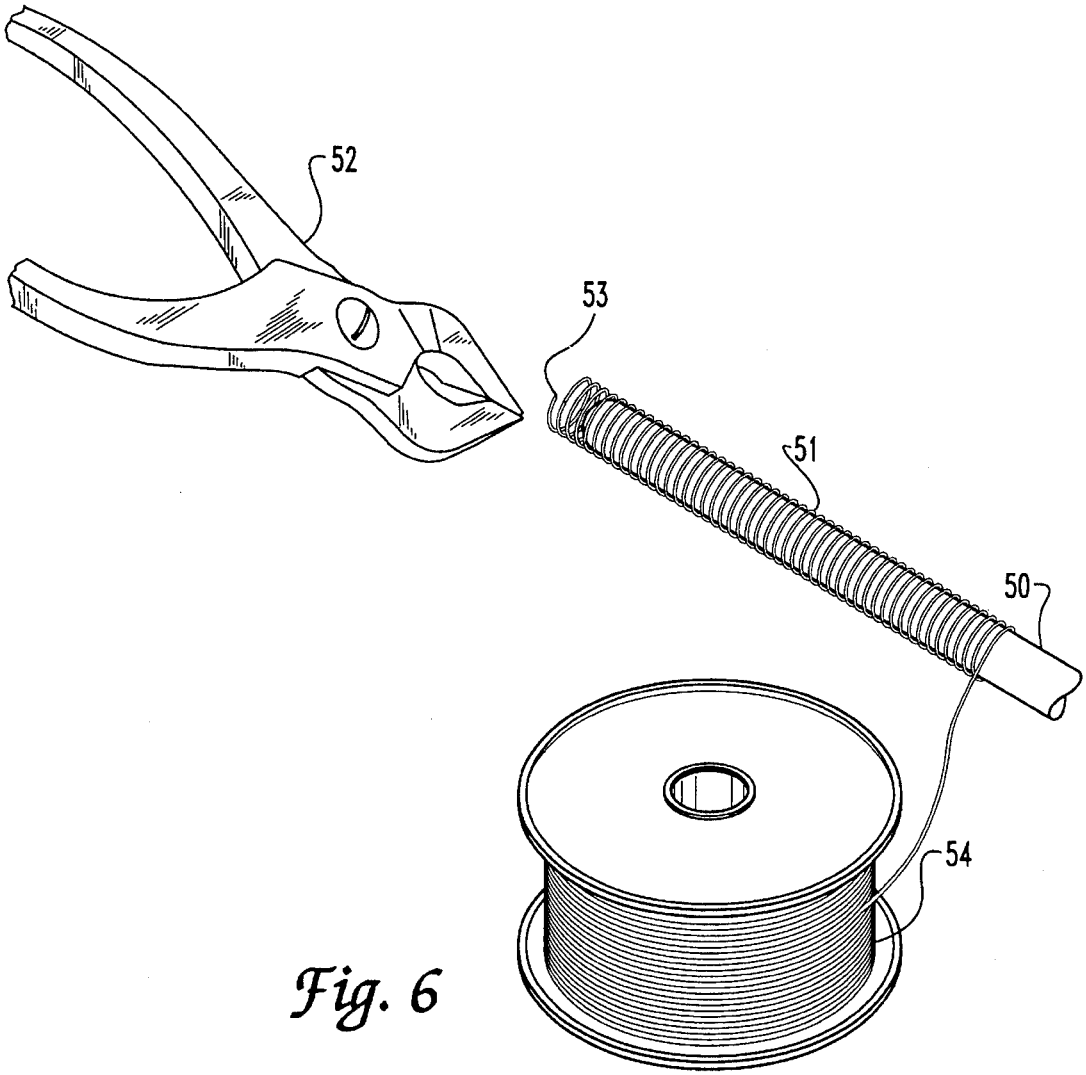
FIG. 6 is an illustrative view of a method for forming the wire form of FIG. 5 that comprises wrapping a length of wire around a mandrel.

With reference to FIG. 6, there is an illustrative view of a preferred method for manufacturing a wire form 25 of the present invention. It should be understood that the wire form 25 could be manufactured by other procedures that provide a wire form of the desired geometric proportion. However, the method of forming a wire form 25 described hereinafter reduces the carrying cost of inventory and provides a great deal of flexibility for the manufacturing concern.

Figure 5:
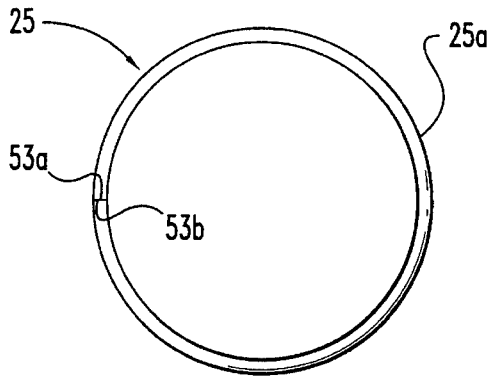
FIG. 5 is a end elevational view of a wire form comprising a portion of the FIG. 3 filtered lamp assembly.

A mandrel 50 having an external diameter approximately corresponding to the diameter of inner cylindrical surface 13 of housing 11 minus twice the diameter of wire 51 is utilized to form the wire form 25. A portion of wire 51 from a spool of wire 54 is wrapped around the mandrel 50. In another form of the present invention the wrapping and cutting of the wire is done by an automated machine, such as a robotic arm. The wire 51 is wrapped around the mandrel, to give it a helical shape, it is slid off the mandrel, and a tool 52 such as a pair of side cutters, is utilized to cut the wire into a single circular section 53 having a length corresponding to the circumference of the mandrel 50. After the section 53 has been cut from the helical portion of wire 51, its ends 53*a* and 53*b* are positioned adjacent one another as best illustrated in FIG. 5. After the ends 53*a* and 53*b* are positioned adjacent one another the section 53 is adjusted to assure that it is planar.

An example will now be described which sets forth a method for producing a light assembly of the present invention. In order to produce the light assembly 10 the light bulb 15 must be positioned within the housing 11. The positioning of the light bulb 15 involves placing the light bulb 15 within the central bore 12 formed in the housing 11. After the light bulb 15 has been positioned in the housing 11 the leads 18 and 19 are placed through the center of wire form 25 and the wire form is placed within the housing 11 adjacent the light bulb 15 to seal between the light bulb 15 and the housing 11. A quantity of solidifiable fluid material is dispensed into one end of the housing 11 to cover the wire form 25 and the light bulb 15. After the solidifiable fluid material has solidified the filter lamp assembly 10 is tested and assembled into a product, such as the aircraft instrument 30 in aircraft 31.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A light assembly, comprising:

a filter housing;

a light bulb positioned within said filter housing, said light bulb having an electrical lead extending therefrom;

a wire form positioned within said housing adjacent said light bulb and around said lead for sealing between said housing and said light bulb; and a seal fixing said light bulb and wire form into position.

2. The light assembly of claim 1, wherein said housing includes a bore large enough to permit the free passage of the light bulb therein.

3. The light assembly of claim 2, wherein said wire form is metal.

4. The light assembly of claim 3, wherein said housing has an inner cylindrical surface, and wherein said wire form snugly engages said inner cylindrical surface.

5. The light assembly of claim 4, wherein said wire form is a ring structure.

6. The light assembly of claim 5, wherein said wire form is formed of a substantially copper material.

7. The light assembly of claim 6, wherein said housing is sealed.

8. The light assembly of claim 7, wherein said light bulb is an incandescent light bulb.

9. The light assembly of claim 8, wherein at least a portion of said housing is an infrared light filter.

10. The light assembly of claim 9, wherein said infrared light filter allows the emission of light having a wavelength in the range between about 380–620 nanometers.

11. The light assembly of claim 10, wherein said seal is an opaque seal for preventing light from being emitted from one end of said housing, said opaque seal positioned adjacent said wire form with said electrical leads extending therethrough.

12. The light assembly of claim 11, wherein said housing is substantially cylindrical.

13. The light assembly of claim 1, wherein said wire form is a ring structure.

14. The light assembly of claim 1, wherein said housing has an inner cylindrical surface, and wherein said wire form snugly engages said inner cylindrical surface.

15. A method for producing a light assembly, including a housing, a light bulb, and a wire form connecting between the housing and the light bulb, comprising:

positioning the light bulb within the housing;

placing the wire form within the housing adjacent the light bulb to seal between the light bulb and the housing;

dispensing a solidifiable fluid material into one end of the housing to cover the wire form and the light bulb; and solidifying the material.

16. The method of claim 15, which further includes forming the wire form.

17. The method of claim 16, wherein forming the wire form includes:

providing a quantity of wire;

wrapping at least a portion of the quantity of wire around a mandrel;

cutting the wire into a section having a length that encircles the mandrel;

removing the section from the mandrel; and positioning the ends of the section adjacent one another.

18. The method of claim 17, which further includes adjusting the section to be planar.

19. In combination:

an aircraft; and a filtered lamp assembly for illuminating a cockpit instrument, comprising:

a housing;

a light bulb positioned within said housing, said light bulb having at least one electrical lead extending therefrom;

a wire form positioned within said housing adjacent said light bulb for sealing between said housing and said light bulb; and an opaque seal for preventing light from being emitted from one end of said housing, said opaque seal positioned adjacent said wire form with said at least one electrical lead extending therethrough.

20. The combination of claim 19, wherein said wire form is metal.

21. The combination of claim 19, wherein said housing has an inner cylindrical surface, and wherein said wire form snugly engages said inner cylindrical surface.

22. The combination of claim 21, wherein said wire form is a ring structure.

* * * * *